US005161335A

United States Patent [19]

Tank

[11] Patent Number: 5,161,335

[45] Date of Patent: Nov. 10, 1992

[54] ABRASIVE BODY

[75] Inventor: Klaus Tank, Johannesburg, South Africa

[73] Assignee: DeBeers Industrial Diamond Division (Proprietary) Limited, Johannesburg, South Africa

[21] Appl. No.: 567,135

[22] Filed: Aug. 14, 1990

[30] Foreign Application Priority Data

Aug. 14, 1989 [ZA] South Africa ..... 89/6181

[51] Int. Cl.[5] ..... B24D 3/00

[52] U.S. Cl. ..... 51/204; 51/309; 76/115; 175/426; 175/434; 228/121

[58] Field of Search ..... 76/115; 175/410, 411; 228/121; 51/210, 211, 204, 309, 206 R, 206 NF, 209 R

[56] References Cited

U.S. PATENT DOCUMENTS

| | | | |
|---|---|---|---|
| 1,956,233 | 4/1934 | Braun | 76/115 X |
| 3,290,835 | 7/1964 | Jeffers . | |
| 3,743,489 | 7/1973 | Wentorf, Jr. et al. | 51/307 |
| 3,745,623 | 7/1973 | Wentorf, Jr. et al. | 29/95 B |
| 3,767,371 | 10/1973 | Wentorf, Jr. et al. | 51/307 |
| 4,063,909 | 12/1977 | Mitchell | 51/309 |
| 4,117,968 | 10/1978 | Naidich et al. | 51/309 X |
| 4,224,380 | 9/1980 | Bovenkerk et al. | 51/309 X |
| 4,225,322 | 9/1980 | Knemeyer . | |
| 4,228,942 | 10/1980 | Dietrich | 51/309 X |
| 4,527,998 | 7/1985 | Knemeyer | 51/309 |
| 4,534,773 | 8/1985 | Phaal et al. | 51/309 X |
| 4,605,343 | 1/1984 | Hibbs, Jr. et al. . | |
| 4,666,466 | 5/1987 | Wilson | 51/307 |
| 4,821,819 | 4/1989 | Whysong | 175/410 |
| 4,899,922 | 2/1990 | Slutz et al. | 228/121 |
| 4,919,220 | 4/1990 | Fuller et al. | 175/410 X |
| 4,941,891 | 7/1990 | Tank et al. | 51/309 X |

FOREIGN PATENT DOCUMENTS

| | | | |
|---|---|---|---|
| 038072 | 6/1972 | European Pat. Off. . | |
| 1151666 | 7/1963 | Fed. Rep. of Germany . | |
| 885847 | 4/1989 | South Africa . | |
| 0668810 | 3/1952 | United Kingdom | 175/410 |
| 2158086 | 5/1962 | United Kingdom . | |
| B1 489130 | 10/1977 | United Kingdom . | |

*Primary Examiner*—M. Rachuba
*Attorney, Agent, or Firm*—Scully, Scott, Murphy & Presser

[57] ABSTRACT

A method is provided which bonds a composite abrasive compact to a cemented carbide pin. The method includes the steps locating a braze alloy having a perforated metal material embedded therein between a surface of the composite abrasive compact and a surface of the cemented carbide pin. The braze alloy has a melting point below that of the metal material. The surfaces are urged together, the temperature of the braze alloy is raised to above its melting point and maintained at this temperature for a short period. The alloy is then allowed to cool and solidify and bond the surfaces together.

17 Claims, 2 Drawing Sheets

ABRASIVE BODY

BACKGROUND OF THE INVENTION

This invention relates to abrasive bodies, particularly abrasive bodies which contain abrasive compacts.

Abrasive compacts are well known in the art and consist essentially of a mass of abrasive particles present in an amount of at least 70 percent, preferably 80 to 90 percent, by volume of the compact bonded into a hard conglomerate. Compacts are polycrystalline masses and can replace single large crystals in many applications. The abrasive particles will be diamond or cubic boron nitride.

Diamond compacts will typically contain a second phase uniformly distributed through the diamond mass. The second phase may contain a dominant amount of a catalyst/solvent for diamond synthesis such as cobalt, nickel or iron. Diamond compacts having second phases of this nature will generally not have thermal stability above 700° C.

Diamond abrasive compacts may be used alone or as composite compacts in which event they are backed with a cemented carbide substrate. Composite diamond abrasive compacts wherein the second phase contains a diamond catalyst/solvent are widely used in industry.

Examples of composite diamond abrasive compacts are described in U.S. Pat. No. 3,745,623 and British Patent Specification No. 1,489,130.

Examples of cubic boron nitride compacts are described in U.S. Pat. Nos. 3,743,489 and 4,666,466.

Diamond abrasive compacts of the type described above are thermally sensitive above a temperature of about 700° C. There are, however, described in the literature and in commercial use several diamond abrasive compacts which are thermally stable above 700° C. Examples of such compacts are described in U.S. Pat. Nos. 4,244,380 and 4,534,773 and British Patent No. 2,158,086.

In some applications, particularly for drilling, it is desirable to bond a composite abrasive compact, particularly a composite diamond abrasive compact, to an elongate cemented carbide pin. The product known as a stud cutter is then brazed to the working surface of a drill crown. During this second brazing, weakening of the bond between the composite compact and the pin is known to occur.

Kennametal South African Patent No. 88/5847 describes a method of bonding an elongate cemented carbide tool insert to the steel body of a conical bit. Bonding is achieved by brazing the carbide to the steel. A perforated metal shim is provided between the carbide and the steel and the braze is allowed to flow through the shim. The presence of the shim is said to reduce stresses in the braze joint. It is to be noted that the bonding is between a carbide surface and a steel surface. Further, the braze alloy is allowed to infiltrate the perforated shim and is not pre-formed with the shim.

SUMMARY OF THE INVENTION

According to the present invention, a method of bonding a surface of an abrasive compact or cemented carbide surface to a cemented carbide surface includes the steps of locating a braze alloy having a perforated metal material embedded therein between the surfaces, the braze alloy having a melting point below that of the metal material, urging the surfaces together, raising the temperature of the braze alloy to above its melting point, and allowing the braze alloy to cool and solidify and bond the surfaces together.

Further according to the invention, there is provided a tool insert comprising an abrasive compact bonded to a cemented carbide substrate, the substrate being bonded to a cemented carbide pin through a braze alloy which has a perforated metal material embedded therein and which has a melting point below that of the metal material.

DESCRIPTION OF EMBODIMENTS

Figure 2:
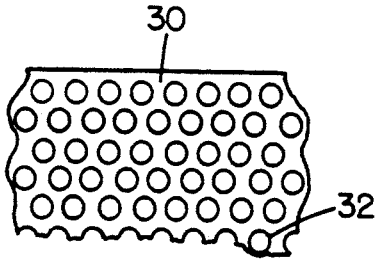
FIGS. 2 to 4 illustrate plan views of examples of perforated metal materials useful in the practise of the invention

The perforated metal material will have a plurality of holes or spaces extending therethrough and which allow for the flow of molten alloy both into the material and through it. The size of the holes may vary between wide limits. For example, the largest linear dimension of the holes may range from a few millimeters down to a few hundred microns. Typically, the largest linear dimension of the holes will be in the range of about 3 mm to 100 microns. Examples of suitable materials are as follows:

1. A metal sheet having holes punched or formed therethrough in a regular or random pattern. An example of such a material is illustrated by FIG. 2 and consists of a metal sheet 30 having a plurality of circular holes 32 punched through it.

Figure 3:
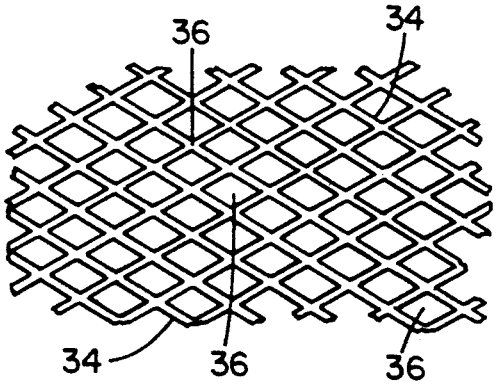

2. An expanded metal mesh. An example of such a mesh is illustrated by FIG. 3 and consists of a plurality of metal strands 34 in a metal structure defining spaces or holes 36 between adjacent strands.

Figure 4:
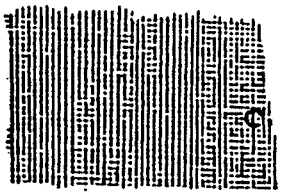
Figure 4A:
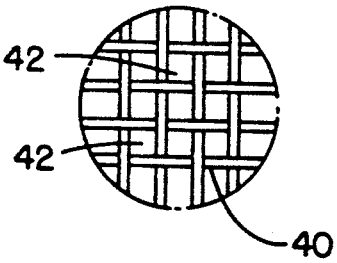
FIG. 4*a* is a blow-up view of a section of FIG. 4.

3. A woven metal net. An example of such a net is illustrated by FIGS. 4 and 4*a* and consists of a series of strands 40 woven to form a net structure. Holes or spaces 42 are defined between adjacent strands 40.

The metal of the material will be a high melting metal, typically one having a melting point above 1400° C. Examples of suitable metals are nickel, palladium, platinum, or an alloy containing one or more of these metals or stainless steel.

It is preferred that the temperature of the braze alloy is not raised too high and to a point where the perforated metal material itself melts.

The perforated metal material acts, in effect, as a reinforcing agent for the braze bond. When the bonded product is subjected to a subsequent heat treatment, as for example, the brazing of the product to the working surface of a tool, it has been found that the shear strength of the braze bond is not significantly reduced when compared with a similar braze bond not including the perforated metal material.

The perforated metal material is embedded in the braze alloy and located as such between the surfaces to be bonded. It has been found important to limit the degree of oxidation of the metal material which may occur during embedding of the material in the braze alloy. Such oxidation has a deleterious effect on the bond strength, particularly after the bond has been subjected to the effects of a secondary brazing operation. The metal material should be substantially free of oxides.

The method of the invention may be used to bond an abrasive compact surface to a cemented carbide surface. It may also be used to bond a cemented carbide surface to another cemented carbide surface. In this latter form of the invention, the cemented cabide surface will typically form part of a composite abrasive compact of the type described in the above-mentioned prior published specifications.

The braze alloy will vary according to the nature of the surfaces being bonded and the temperature sensitivity of components carried by, or in close proximity to, the surfaces. As a general rule, the melting point of the braze alloy will not exceed 1000° C. When one of the surfaces being bonded is that of a temperature sensitive diamond compact or where one of the surfaces being bonded is a carbide surface of a composite diamond abrasive compact, then the braze alloy would preferably have a melting point not exceeding 900° C.

The load which is applied to urge the surfaces being bonded together will typically be in the range 200 to 300 kPa.

The braze alloy will generally not be maintained at the elevated temperature, i.e. above its melting point, for more than a few minutes. Generally, this elevated temperature will be maintained for a period of less than 1 minute.

The invention has particular application to the bonding of a composite abrasive compact to an elongate cemented carbide pin. In this form of the invention, there will be bonding between a carbide surface of the composite compact and a surface of the pin. A particularly suitable braze alloy for this application is one which has the following composition, by weight:

| | |
|---|---|
| Mn | 15 to 41% |
| Cu | 67 to 41% |
| Ni | 1 to 5% |
| Au | 10 to 17% |

Alloys of this composition have a melting point in the region of 900° C.

Figure 1:
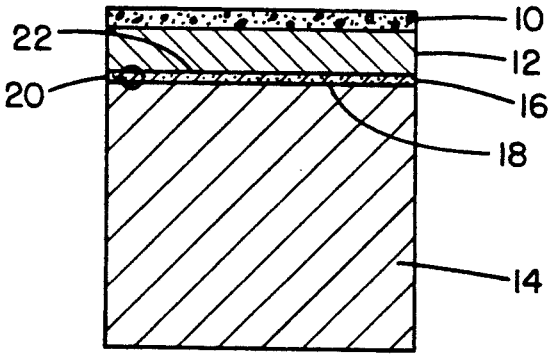
FIG. 1 illustrates a sectional side view of an assembly being bonded by the method of the invention.
Figure 1A:
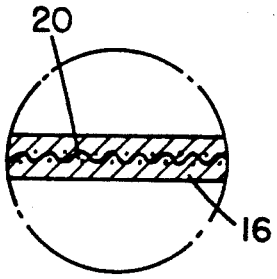
FIG. 1*a* is a blown-up view of a section thereof.

An embodiment of the invention will now be described with reference to FIG. 1 of the accompanying drawing. Referring to this drawing, there is shown a composite abrasive compact comprising a diamond compact 10 bonded to a cemented carbide support 12. The diamond compact has a cobalt second phase and is sensitive to temperatures exceeding about 900° C. This composite compact is bonded to an elongate cemented carbide pin 14 to produce a tool component useful for drilling applications. This bonding is achieved by placing a layer 16 of a braze alloy on the upper surface 18 of the pin 14. An expanded nickel mesh 20 is embedded in the braze alloy. The lower surface 22 of the carbide support 12 is then brought into contact with the braze alloy. A load is applied to the composite compact and the pin to urge the surfaces 18 and 22 together. Localised heating is applied to the braze alloy, for example by induction heating, to raise the temperature of the braze alloy to above its melting point. At this temperature, the nickel mesh remains solid and the alloy flows and wets the surfaces 18, 22. The elevated temperature is maintained for a period of 3 to 5 seconds and then removed. The alloy cools and solidifies and bonds the surfaces 22 and 18 together. An extremely strong bond results and this bond is not seriously weakened when the bonded product is subsequently brazed into the working surface of an appropriate drill crown.

Bonded products as described with reference to FIG. 1 were produced using a variety of perforated metal materials. In each case, the perforated metal material was embedded in a braze alloy consisting of 53% copper, 29% manganese, 14,5% gold and 3,5% nickel, all percentages being by weight. The bond strength was determined both as brazed and after the product had been subjected to a secondary brazing cycle of being heated to 700° C. and held at this temperature for two hours.

These bonded products were compared with similar products produced using the same braze alloy without any perforated metal material and a similar product using the same braze alloy and a solid nickel shim.

Figure 5:
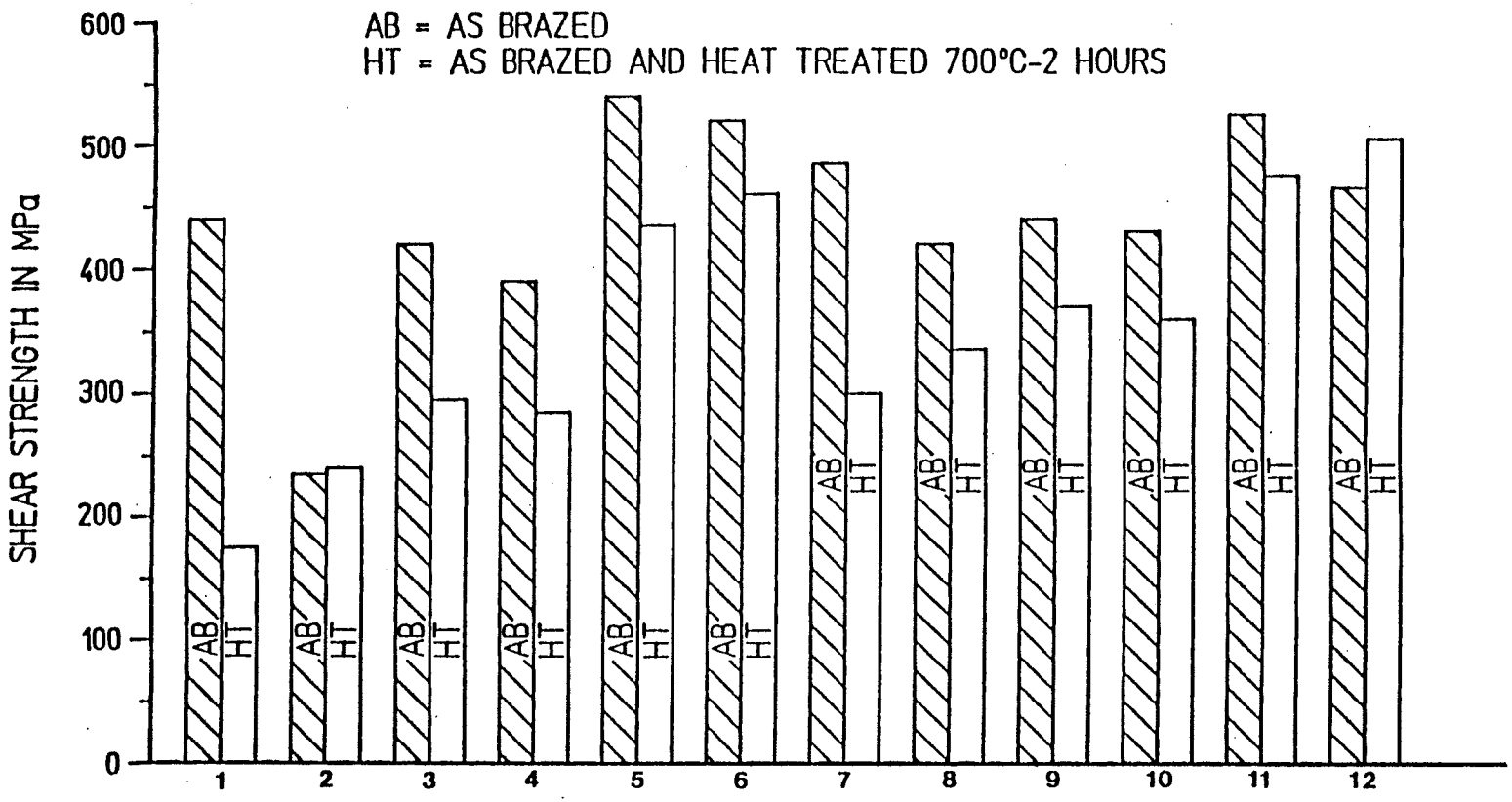
FIG. 5 illustrates graphically results of certain tests carried out.

The shear strengths of the bond (in MPa) for each product, both as brazed and after heat treatment, are set out graphically in the attached FIG. 5. In this figure, the various bonded products, identified by their bonding layers, are as follows:

1. Braze alloy without a perforated metal material.
2. Solid nickel shim 0,1 mm thick.
3. Perforated Ni-shim 0,1 mm thick.
4. Perforated Ni-shim 0,1 mm thick.
5. Woven Ni-net 0,15 mm thick.
6. Expanded Ni-mesh 0,2 mm thick.
7. Fine mesh, expanded nickel.
8. Coarse mesh, expanded nickel.
9. Fine mesh, expanded stainless steel.
10. Coarse mesh, expanded stainless steel.
11, 12. Oxide free alloy with woven nickel net centre layer.

Products 1 and 2 are not according to the invention. The remaining products are according to the invention. It will be noted that the shear strengths of the bonds after heat treatment in the case of the bonded products of the invention are superior to those of the bonded products 1 and 2 which are not according to the invention.

I claim:

1. A method of bonding a cemented carbide surface of a composite abrasive compact to a cemented carbide surface of a cemented carbide body comprising the steps of locating a braze alloy having a perforated metal material embedded therein between the surfaces, the braze alloy having a melting point below that of the metal material, urging the surfaces together, raising the temperature of the braze alloy to above its melting point, and allowing the braze alloy to cool and solidify and bond the surfaces together.

2. A method according to claim 1 wherein the temperature is raised to a point at which the braze alloy melts, but at which the metal material does not melt.

3. A method according to claim 1 wherein a cemented carbide surface of a composite diamond abrasive compact is bonded to another cemented carbide surface.

4. A method according to claim 1 wherein the braze alloy has a melting point not exceeding 900° C.

5. A method according to claim 1 wherein the perforated metal material is selected from a sheet having holes formed therein, an expanded metal mesh a metal net.

6. A method according to claim 1 wherein the perforated metal material is substantially free of any oxides.

7. A method according to claim 1 wherein the metal of the perforated metal material is selected from the group consisting of nickel, palladium and platinum and alloys containing one or more of these metals.

8. A method according to of claim 1 wherein the metal of the perforated metal material is stainless steel.

9. A method according to claim 1 wherein the braze alloy has the following composition, by weight:

| | |
|---|---|
| Mn | 15 to 41% |
| Cu | 67 to 41% |
| Ni | 1 to 5% |
| Au | 10 to 17% |

10. A tool insert comprising an abrasive compact bonded to a cemented carbide substrate, the substrate being bonded to a cemented carbide pin through a braze alloy which has a perforated metal material embedded therein and which has a melting point below that of the metal material.

11. A tool insert according to claim 10 wherein the abrasive compact is a diamond abrasive compact.

12. A tool insert according to claim 10 wherein the braze alloy has a melting point not exceeding 900° C.

13. A tool insert according to claim 10 wherein the braze alloy has the following composition, by weight:

| | |
|---|---|
| Mn | 15 to 41% |
| Cu | 67 to 41% |
| Ni | 1 to 5% |
| Au | 10 to 17% |

14. A tool insert according to claim 10 wherein the perforated metal material is selected from a sheet having holes formed therein, an expanded metal mesh or a metal net.

15. A tool insert according to claim 10 wherein the perforated metal material is substantially free of any oxides.

16. A tool insert according to claim 10 wherein the metal of the perforated metal material is selected from nickel, palladium, and platinum and alloys containing one or more of these metals.

17. A tool insert according to claim 10 wherein the metal of the perforated metal material is stainless steel.

* * * * *

UNITED STATES PATENT AND TRADEMARK OFFICE

CERTIFICATE OF CORRECTION

PATENT NO. : 5,161,335

DATED : November 10, 1992

INVENTOR(S) : Klaus Tank

It is certified that error appears in the above-identified patent and that said Letters Patent is hereby corrected as shown below:

Column 4, line 67, Claim 5: after "mesh" insert --or--

Signed and Sealed this

Nineteenth Day of October, 1993

Bruce Lehman

*Attest:*

BRUCE LEHMAN

*Attesting Officer*

*Commissioner of Patents and Trademarks*